US005392769A

United States Patent [19]

Siegel

[11] Patent Number: 5,392,769

[45] Date of Patent: Feb. 28, 1995

[54] ONE-WAY VALVE

[75] Inventor: John H. Siegel, Des Moines, Wash.

[73] Assignee: Vinatroics Division, Seattle, Wash.

[21] Appl. No.: 956,740

[22] Filed: Oct. 6, 1992

[51] Int. Cl.[6] ..... A62B 18/10

[52] U.S. Cl. ..... 128/201.28; 128/201.29; 128/205.24

[58] Field of Search ..... 128/201.25, 201.28, 128/201.29, 205.24; 137/454.2

[56] References Cited

U.S. PATENT DOCUMENTS

| | | | |
|---|---|---|---|
| 2,174,503 | 9/1939 | Whipple | 137/454.2 |
| 3,049,896 | 8/1962 | Webb | 128/201.29 |
| 3,516,404 | 6/1970 | Spross | 128/201.29 |
| 3,519,012 | 7/1970 | Van Patten | 137/512.15 |
| 3,527,242 | 9/1970 | Ansite | 137/102 |
| 3,954,121 | 5/1976 | Kardos | 137/525 |
| 4,458,680 | 7/1984 | Childers et al. | 128/201.29 |
| 4,565,214 | 1/1986 | Parman | 137/512.15 |
| 4,712,574 | 12/1987 | Perrott | 137/454.2 |
| 4,805,661 | 2/1989 | Knapp | 137/218 |
| 5,027,784 | 7/1991 | Osawa | 123/572 |
| 5,095,940 | 3/1992 | Saur et al. | 251/904 |

FOREIGN PATENT DOCUMENTS 1600614 10/1981 United Kingdom .

*Primary Examiner*—Edgar S. Burr
*Assistant Examiner*—Aaron J. Lewis
*Attorney, Agent, or Firm*—Shlesinger Arkwright & Garvey

[57] ABSTRACT

The one-way valve is preferably formed of lightweight material such as plastic and includes a highly flexible rubber or plastic membrane which seals against a sealing edge to prevent the back flow of air therethrough but may be readily lifted off the edge by air flowing in the desired direction. A number of protuberances prevent seating of the membrane against the exhaust openings and the valve face and a spider member supports the valve within the valve housing. An enlarged flange extends about the valve which may be sealed by suitable means such as adhesive or heat to the protective clothing in which the valve is intended to be installed. The protective clothing is formed of impermeable material, preferably polyethylene plastic. An air supply hose is attachable to the clothing to supply air to the interior of the protective clothing from an outside air source.

8 Claims, 3 Drawing Sheets

ONE-WAY VALVE

FIELD OF THE INVENTION

This invention relates to one-way valves and more particularly to valves for preventing backflow of contaminated air into an occupied area such as a suit of contamination prevention clothing.

BACKGROUND OF THE INVENTION

Protecting a worker from the effects of contaminated air and dangerous vapors has been generally accomplished in the past by the use of protective clothing which seals the outside air away from the worker and breathing air has been provided to the worker through use of compressed air tanks. Two of the main inadequacies of this arrangement has been (1) the clothing used to seal the worker from the contaminated air also seals in the air around the worker's body and creates a generally uncomfortable condition due to the build up of heat and water vapor inside the protective clothing, and (2) anyone who has carried compressed air tanks on their back for any period of time can tell you that the tanks themselves are quite heavy and carrying them around is exhausting work, without attempting to perform another job while carrying the tank. Furthermore, use of air tanks limits the amount of time a worker can expend in the containment area before leaving to obtain a new supply of air.

Therefore, it can be seen, in view of the foregoing that there is a need for a new form of protective clothing incorporating a one-way air valve to release the air from the protective suit and a new method of protecting oneself from a hazardous environment.

OBJECTS AND SUMMARY OF THE INVENTION

One of the most important objects of the invention is to provide a one-way valve for preventing backflow of air into protective clothing.

Another object of the invention is to provide a one-way valve which allows air to exhaust from the suit of protective clothing.

Still another object of the invention is to provide a valve which is formed minimum of parts and can be constructed inexpensively.

Still another object of the invention is to provide a valve formed of lightweight material which can easily be assembled without fasteners.

In summary, therefore, the invention relates to a one-way valve for use in expelling air from a suit of protective clothing so that a constant flow of air from an outside source, such as an air hose can supply fresh, uncontaminated air to the suit of the wearer which will allow breathing of the air inside the suit and permit circulation of air through the suit to prevent the wearer from becoming overheated and to further prevent the premature exhaustion experienced in carrying compressed air tanks.

The one-way valve is preferably formed of lightweight material such as plastic preferably one of the groups of: polyethylene, 5/B polyurethane, polyvinylchloride, and spunbound polyolefin and includes a highly flexible rubber or plastic membrane which seals against a sealing edge to prevent the back flow of air therethrough but may be readily lifted off the edge by air flowing in the desired direction. A number of protuberances prevent seating of the membrane against the exhaust openings and the valve face and a spider member supports the valve within the valve housing. An enlarged flange extends about the valve which may be sealed by suitable means such as adhesive or heat to the protective clothing in which the valve is intended to be installed. The protective clothing is formed of air impermeable material, preferably one of the groups of polyethylene, 5/B polyurethane, polyvinylchloride and spunbound polyolefin. If the valve and clothing are each constructed of materials which are incompatible for welding purposes, the valve and clothing may be joined using adhesive such as the Trusafe PERMATAC™ adhesive donut. An air supply hose is attachable to the clothing to supply air to the interior of the protective clothing from an outside air source.

Other features and advantages of the invention will be set forth in or apparent from, the detailed description of the preferred embodiments of the invention which follows.

DETAILED DESCRIPTION OF THE INVENTION

Figure 1:
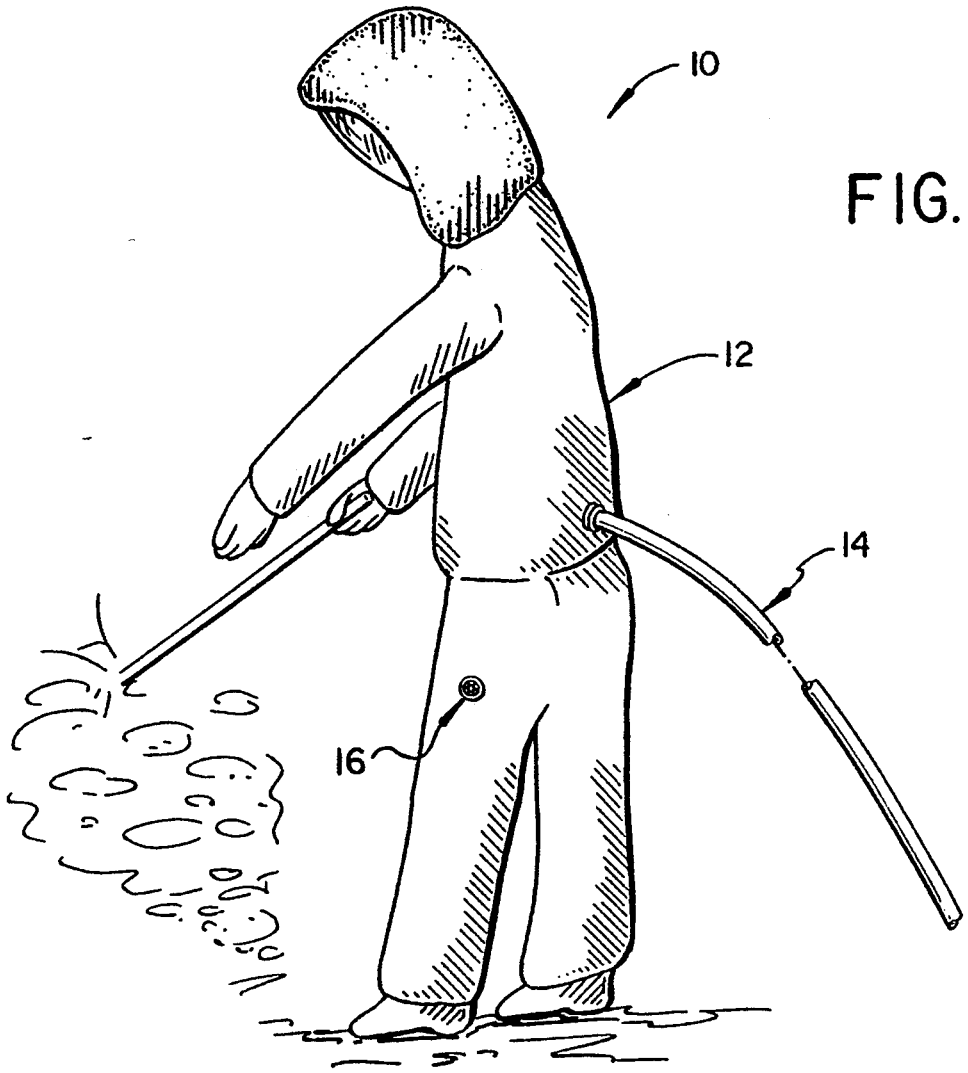
FIG. 1, shows a worker wearing the protective suit in which the one-way valve is installed.

In FIG. 1, a worker 10 is shown wearing the suit of protective clothing 12 which may be constructed of which protects the worker from a contaminated environment. An air supply hose 14 provides air to the suit 12 from an outside air source (not shown). The suit 12 is sealed to protect the worker 10 from the contaminated air. In order to prevent the suit 12 from exploding due to the input of air from the air hose 14, the one-way valve 16 is attached to an unobtrusive portion of the suit 12 to allow the release of excess air as well as exhaust exhaled air from the suit 12.

Figure 2:
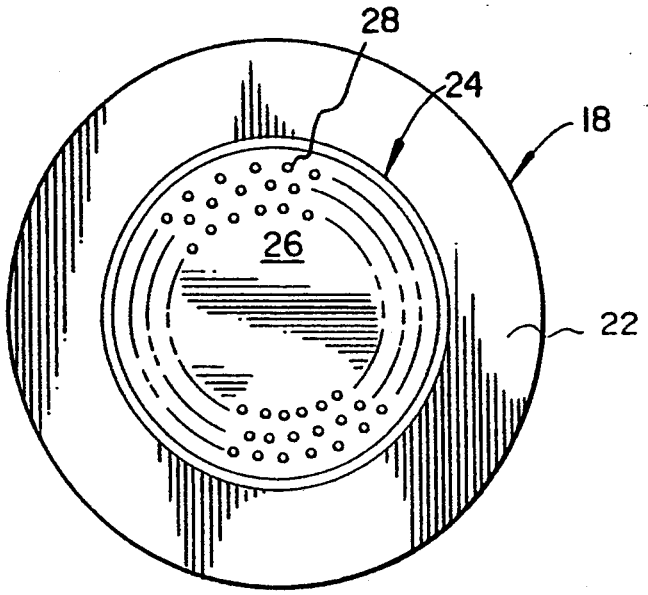
FIG. 2, is a front view of the exterior face of the one-way valve.
Figure 3:
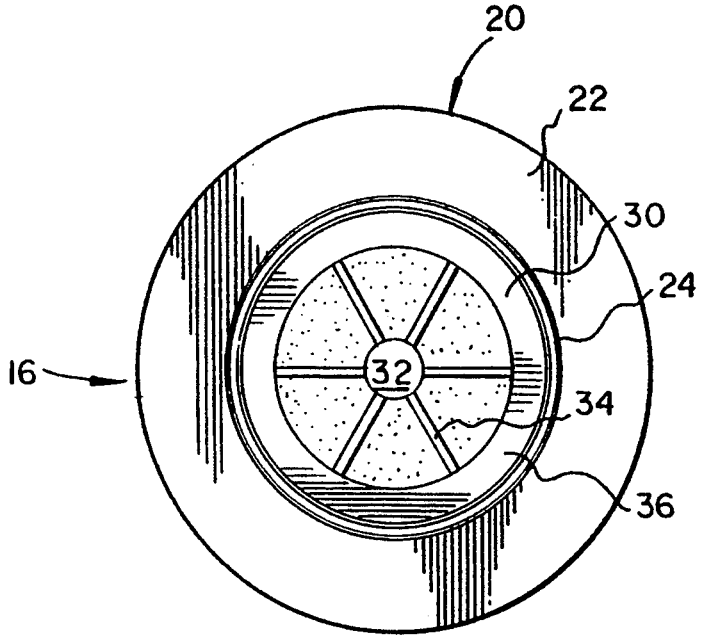
FIG. 3, is a rear view of the rear face of the one-way valve.

FIGS. 2 and 3 show the front 18 and back 20, respectively, of the one-way valve 16. As can be seen from the front view of FIG. 2, the valve 16 includes a flange 22 circumscribing the valve housing 24. Valve housing 24 includes a front face 26 formed of a solid substantially flat portion having a substantial number of perforations 28 therein to allow the exhaust of air through the valve 16. In FIG. 3, the flange 22 circumscribing the valve 16 can be seen in relation to the valve housing 24. Within the valve housing 24 is a valve support member 30 formed of substantially rigid plastic material and includes a central disc-shaped portion 32 and a plurality of spider-like legs 34 extending between the outer ring 36 and the central disc 32.

Figure 4:
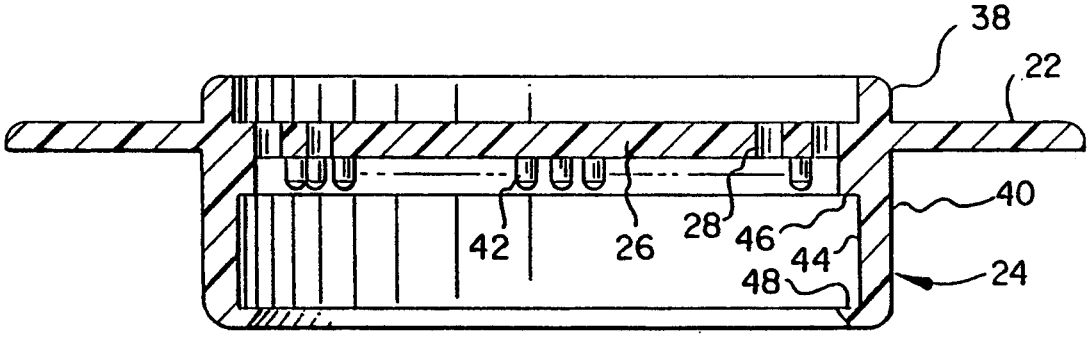
FIG. 4, is a cross-sectional view of the valve housing.

FIG. 4 shows a cross-sectional view of the valve housing 24 and the circumscribing flange 22. As can be seen from the figure, the valve housing 24 includes an upper portion 38 extending above the flange 22 and a lower portion 40 extending below the flange 22. The openings 28 extend through the front face 26 which permit air to pass through the valve face 26 when the valve 16 is in use. A plurality of protuberances 42 extend downwardly from the front face 26. Lower portion 40 includes a recessed area 44 having an upper lip 46 and a lower lip 48.

Figure 5:
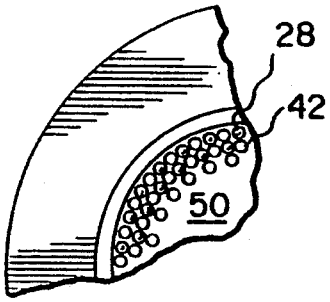
FIG. 5, is a partial broken away view of the bottom of the valve face shown in FIG. 4.

FIG. 5 shows a partial section of the bottom side 50 of the front face 26 and shows the relationship between protuberances 42 and openings 28.

Figure 6:
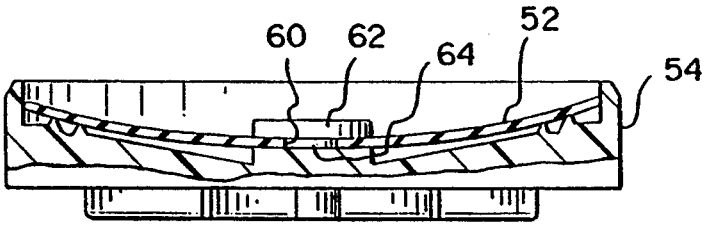
FIG. 6, is a cross-sectional view of the valve seal.
Figure 7:
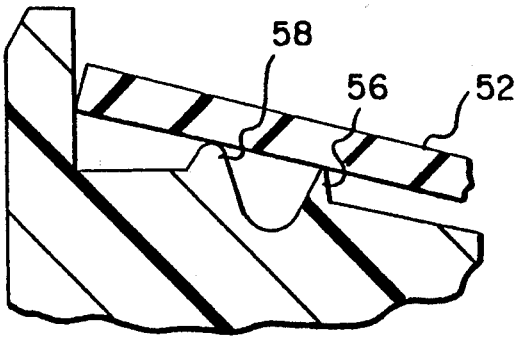
FIG. 7, is an enlarged partial broken away view of the cross-section of FIG. 6 showing the sealing edge structure.
Figure 8:
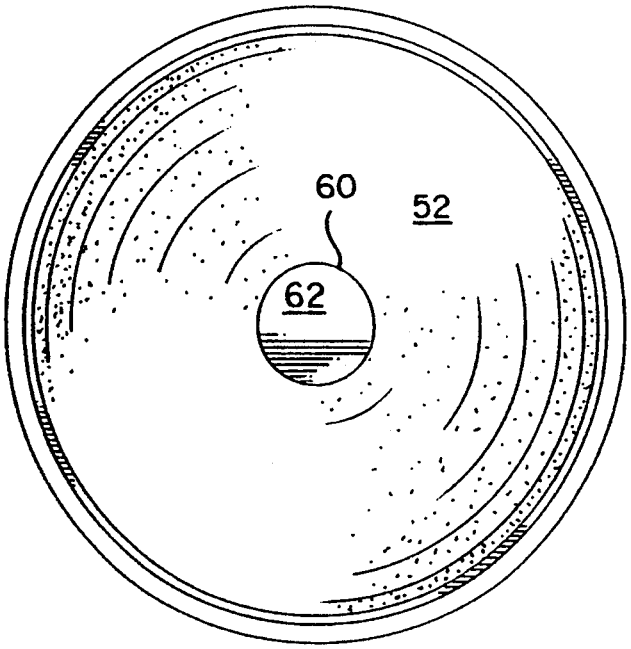
FIG. 8, is a top view of the valve structure of FIG. 6.

FIG. 6 shows the valve membrane 52 held within the valve sealing structure 54 which in use is held within recessed area 44 between upper lip 46 and lower lip 48 of the valve housing 24. Sealing of the valve membrane 52 against the membrane housing 54 is accomplished by seating of the valve membrane 52 against sealing edges 56 and 58. The sealing edges 56 and 58 are more clearly shown in FIG. 7 which forms a substantially airtight contact point for the valve membrane 52. The top of the valve membrane 54 is shown in FIG. 8 which is formed of a disc of highly flexible material such as plastic or rubber. The valve membrane 52 includes an opening 60 therein which is best shown in FIG. 6 to allow assembly of the valve membrane over the membrane positioning head 62. Head 62 includes a smaller neck 64 so that the elastic membrane opening 60 may be enlarged to fit over head 62 and then retract around neck.

The protuberances 42 as shown in FIGS. 4 and 5 prevent membrane 52 from sealing against openings 28 and prevent the exhaust of air.

Preferably, the acceptable pressures to prevent a ballooning effect of the protective suit 12 are such that air may flow into the suit and exhaust through the one-way valve without unnecessary expansion or billowing of the suit. An expanded suit can be hazardous to the workers' safety by obscuring vision and reducing flexibility. It is important that the suit 12 maintain an unexpanded condition and in order to achieve this object, a flow rate table has been produced and is identified below as Table 1 showing the acceptable back pressure for a given flow rate.

TABLE 1

| Flowrates SCFM | Acceptable Back Pressured (psig) |
|---|---|
| 5 | .015-.035 |
| 10 | .02-.04 |
| 15 | .03-.05 |
| 20 | .05-.09 |
| 25 | .11-.14 |

Figure 9:
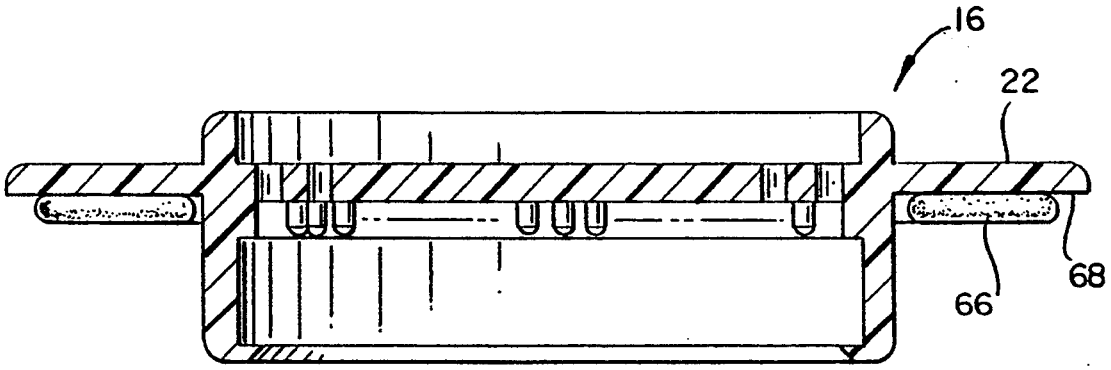
FIG. 9, shows the valve of FIG. 4 in combination with the adhesive donut.

FIG. 9 shows the use of the PERMATAC TM adhesive donut 66 applied to the underside 68 of flange 22 which when bonded to flange 22 and the protective suit 12 surrounding valve 16, an air tight seal is formed and the valve 16 becomes virtually permanently bonded to flange 22 and the suit 12.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A one-way air valve adapted for use in clothing, said valve comprising:

a) a substantially cylindrically walled base member having a center an outer end and an inner end and an outer flange member adapted for engaging a clothing surface;

b) said base member further includes a central perforated wall extending substantially perpendicularly to said cylindrical wall and forming an outer face of the air valve;

c) said inner end of said base member having a lower lip extending perpendicularly from said cylindrical wall and toward the center of said base member;

d) an insertable membrane support member for a connection to said base member;

e) said support member being sized for engagement within said inner end of said base member between said perforated wall and said lower lip;

f) said support member having a central retaining portion for engaging a valve membrane and a substantially rigid membrane supporting web for supporting said membrane between said web and said perforated wall; and, g) whereby said membrane is flexible to allow air to exhaust through said perforated wall while preventing air from entering from said perforated wall by seating against said support member.

2. The air valve as set forth in claim 1, wherein:

a) said perforated wall is spaced inwardly from said outer end of said base member.

3. The air valve as set forth in claim 1, wherein:

a) said membrane support member is detachable from said base member.

4. The air valve as set forth in claim 1, wherein:

a) said perforated member includes depending protuberances extending toward said membrane for preventing sealing of said membrane against said perforated member and preventing exhaust of air.

5. The air valve as set forth in claim 1, wherein:

a) said support member includes a sealing edge surrounding said web for engaging said membrane to prevent back flow of air through said web.

6. The air valve as set forth in claim 5, wherein:

a) said support member includes a pair of sealing edges circumscribing said web.

7. The air valve as set forth in claim 6, wherein:

a) said pair of sealing edges includes a first sealing edge and a second sealing edge wherein said first sealing edge forms a sharp peak and said second sealing edge forms a dull peak whereby a secure seal is formed between said membrane and said support member.

8. The air valve as set forth in claim 6, wherein:

a) said membrane normally rests against said sealing edges when air is not being exhausted through said perforated wall.

* * * * *